US009278457B2

(12) United States Patent
Koch

(10) Patent No.: US 9,278,457 B2
(45) Date of Patent: Mar. 8, 2016

(54) SLICING MACHINE FOR FOOD

(75) Inventor: Nikolaus Koch, Geislingen (DE)

(73) Assignee: BIZERBA GMBH & CO. KG, Balingen (DE)

( * ) Notice: Subject to any disclaimer, the term of this patent is extended or adjusted under 35 U.S.C. 154(b) by 322 days.

(21) Appl. No.: 13/808,254

(22) PCT Filed: Jul. 5, 2011

(86) PCT No.: PCT/EP2011/003321
§ 371 (c)(1),
(2), (4) Date: Mar. 6, 2013

(87) PCT Pub. No.: WO2012/003959
PCT Pub. Date: Jan. 12, 2012

(65) Prior Publication Data

US 2013/0167701 A1 Jul. 4, 2013

(30) Foreign Application Priority Data

Jul. 8, 2010 (DE) ..... 10 2010 026 439

(51) Int. Cl.
*B26D 7/06* (2006.01)
*B26D 1/143* (2006.01)
*B26D 7/22* (2006.01)

(52) U.S. Cl.
CPC ..... *B26D 7/0616* (2013.01); *B26D 1/143* (2013.01); *B26D 7/225* (2013.01); *B26D 2210/02* (2013.01); *Y10T 83/6608* (2015.04)

(58) Field of Classification Search
CPC ..... B26D 7/0616; B26D 1/143; B26D 7/225; B26D 2210/02; Y10T 83/6608
USPC ..... 83/932, 717, 718, 703, 707, 435.11, 83/734, 373, 719, 397, 397.1, DIG. 1, 743, 83/730
See application file for complete search history.

(56) References Cited

U.S. PATENT DOCUMENTS 3,442,312 A * 5/1969 Karp ..... 83/68
4,541,319 A * 9/1985 Maurer et al. ..... 83/707

(Continued)

FOREIGN PATENT DOCUMENTS

DE 2749652 A1 5/1979
DE 4429628 A1 2/1996

(Continued)

OTHER PUBLICATIONS

European Patent Office, International Search Report in International Patent Application No. PCT/EP2011/003321 (Oct. 18, 2011).

*Primary Examiner* — Omar Flores Sanchez
(74) *Attorney, Agent, or Firm* — Leydig, Voit & Mayer, Ltd.

(57) ABSTRACT

The invention relates to a slicing machine (1) for cutting food slices by means of a carriage (2) that can be moved back and forth and a rotating cutting blade (11), wherein the slice thickness can be adjusted by means of a stop plate (12). For cleaning purposes, the carriage (2) can be emptied by tipping the carriage. In order to reduce the risk of injury during cleaning work, a blocking device is provided, which allows the carriage to be emptied by tipping the carriage only in a certain position and while the stop plate is blocked. Said safety feature is provided by means of a blocking slide (41), on which two mechanical safety precaution elements act independently.

20 Claims, 4 Drawing Sheets

(56) References Cited

U.S. PATENT DOCUMENTS

| | | | | |
|---|---|---|---|---|
| 4,813,316 | A * | 3/1989 | Johnson et al. | 83/42 |
| 5,615,591 | A * | 4/1997 | Scherch et al. | 83/399 |
| 5,687,626 | A | 11/1997 | Scherch et al. | |
| 6,016,734 | A | 1/2000 | Koch | |
| 6,209,438 | B1 * | 4/2001 | Mitchell et al. | 83/729 |
| 7,234,382 | B2 * | 6/2007 | Zhu | 83/729 |
| 7,637,191 | B2 * | 12/2009 | Zeeb et al. | 83/703 |
| 7,721,638 | B2 * | 5/2010 | Verhalen et al. | 83/718 |
| 8,043,142 | B2 * | 10/2011 | Zeeb et al. | 451/192 |
| 8,082,830 | B2 * | 12/2011 | Rummel et al. | 83/730 |
| 2003/0079589 | A1 * | 5/2003 | Kovacs | 83/42 |
| 2007/0044625 | A1 * | 3/2007 | Rote et al. | 83/703 |

FOREIGN PATENT DOCUMENTS

| | | | |
|---|---|---|---|
| DE | 69636465 | T2 | 4/2007 |
| WO | WO 9605952 | A1 | 2/1996 |
| WO | WO 0187551 | A2 | 11/2001 |

* cited by examiner

SLICING MACHINE FOR FOOD

CROSS REFERENCE TO RELATED APPLICATIONS

This application is a U.S. National Phase application under 35 U.S.C. §371 of International Application No. PCT/EP2011/003321, filed on Jul. 5, 2011, and claims benefit to German Patent Application No. DE 10 2010 026 439.3, filed on Jul. 8, 2010. The International Application was published in German on Jan. 12, 2012, as WO 2012/003959 A1 under PCT Article 21(2).

FIELD invention relates to a slicing machine for cutting slices of a preferably elongated food product.

BACKGROUND

Slicing machines are used in actual practice to cut slices of food such as, for instance, cold cuts, meat or cheese. The rotating blade is a true source of danger. For this reason, the goal is to design the slicing machines in such a way that the user can operate the machine as safely as possible. Particularly when the blade is being cleaned, there is a greater risk of injury, so that efforts are aimed at covering the cutting edge of the blade to the greatest extent possible while it is being cleaned.

International patent application WO 9605952 A1 discloses such a slicing machine in which the carriage for the food to be sliced can only be flipped open for cleaning purposes if the cutting thickness setting of the stop plate is less than zero. When the cutting thickness is set to less than zero, the stop plate moves in front of the cutting edge of the blade and covers it. This largely eliminates the risk of injury by the cutting edge. A bolt that can be moved linearly, that is joined to the carriage foot by a guide and that interacts via a pivoting lever having an adjustment dial for adjusting the stop plate prevents the carriage from swinging out. A drawback, however, is that this design is relatively complicated to construct.

An aspect of the invention is based on the objective of creating a slicing machine that has a safe cleaning position in which the cutting edge is covered, that has a simple construction and especially that can be made with just a few parts.

SUMMARY

This application provides a slicing machine for cutting slices of a food product, the machine comprising: a machine housing including a circular blade that rotates in a cutting plane and a stop plate that can be moved by an adjustment device perpendicular to the cutting plane; a guide device; a carriage that is mounted so that it can be moved by the guide device parallel to the cutting plane; and a blocking mechanism, wherein the guide device includes a guide pin that runs parallel to the cutting plane and a guide rail arranged at a distance from it, wherein the carriage is mounted so that it can be moved linearly on the guide pin and on the guide rail, and it can be swung out around a pivot pin that runs parallel to the guide pin, wherein the blocking mechanism is configured to prevent the carriage from swinging out during a cutting operation, wherein the blocking mechanism includes a blocking slide that is mounted directly on the carriage via a pivot bearing, and wherein the blocking slide is configured to prevent the carriage from swinging out during a cutting operation such that the guide rail that interacts with the adjustment device and a blocking bar block movement of the blocking slide.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
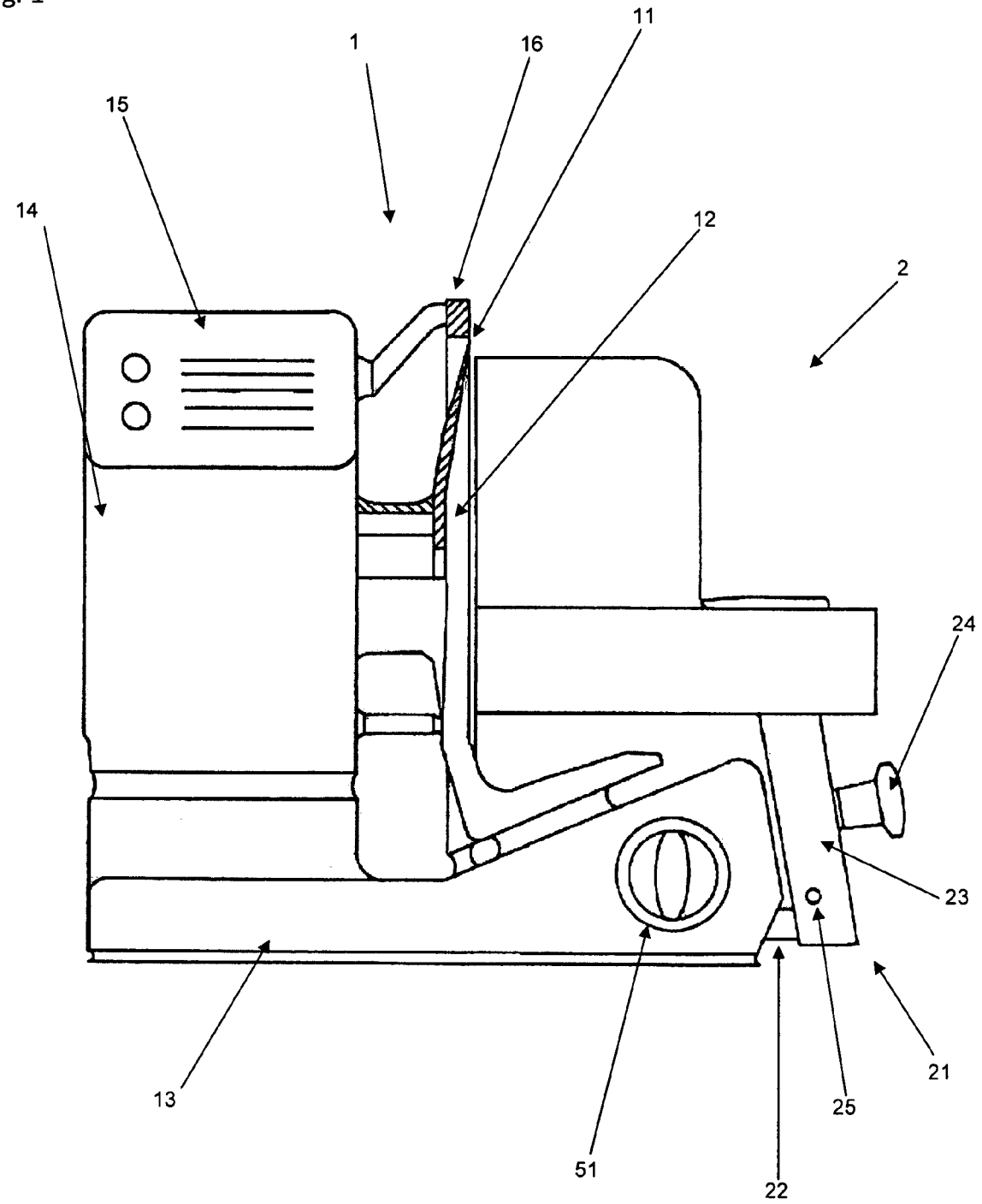
FIG. 1 a view of a slicing machine.

The slicing machine has a blocking mechanism that prevents the carriage from swinging out beyond a blocking slide that is joined to the carriage. Here, the blocking slide interacts with two blocking elements that both act upon the blocking slide. A first blocking element, namely, a blocking bar that interacts with the adjustment device used for the cutting thickness or the slice thickness, prevents the blocking slide from moving perpendicular to the cutting plane, thus preventing the carriage from swinging out during operation. In this context, the cutting plane is defined by the rotating blade of the slicing machine. The slicing machine can be configured as a vertical cutter with a vertical cutting plane or as a slanted cutter with a cutting plane that is slanted with respect to the vertical.

The term cutting operation refers to a situation in which the stop plate has been set at a cutting thickness or slice thickness that is equal to or greater than zero. Only when the cutting thickness has been set to below zero, that is to say, when the stop plate is in front of the cutting edge of the blade, does the blocking bar release the blocking slide. In order for the carriage to be swung out into a cleaning position, it is still necessary for the second blocking element, namely, the guide rail, to release the blocking slide. Consequently, a single component, namely, the blocking slide, provides dual protection in that two safety settings have to be established before the carriage can be swung out. This translates into a safe operation of the slicing machine, along with a compact design and a smaller number of components. Here, the swinging-out position to be selected is a predefined position of the carriage, preferably an end position of the carriage. There can be several positions into which the carriage can be swung out.

It is provided that the blocking slide is secured on the carriage or on the carriage foot. Thus, the blocking slide moves along with the carriage. The blocking slide is supported on the guide rail by means of a tab or projection, thus blocking any movement of the blocking slide perpendicular to the cutting plane. At a defined position, the guide rail has a groove into which the blocking slide can engage. Thus, movement of the blocking slide perpendicular to the cutting plane is permitted at a defined position, so that the carriage can be swung out.

In one embodiment, it is provided that the carriage foot is configured in two parts, namely, an upper part and a lower part, which are rotatably joined to each other by means of a pivoting pin. The lower part of the carriage foot supports the blocking slide so that it can be moved linearly and engages into the housing of the slicing machine. The lower part is joined to the housing of the slicing machine by means of a guide pin and a guide rail.

In order to achieve an improved support for the forces and/or torques that occur, the lower part of the carriage foot has a leg that protrudes upwards or downwards. The leg rests on the guide rail arranged above or below the carriage foot by means of a two-point guidance. One bearing point of the guide is formed by a roller that rolls along the guide rail and supports the carriage foot in one support direction. The second bearing point of the guide is formed by a preferably adjustable sliding pin that is arranged at a right angle relative to the support direction of the sliding roller. It additionally supports the guide rail perpendicular to the support direction. This translates into a mechanically stable guidance of the carriage with as few components as possible.

A further simplification of the design is achieved by providing that one end of the blocking bar is rotatably mounted on the guide rail, while the other end interacts with a control disk of the adjustment device that serves to set the cutting thickness.

One application of the slicing machine according to the invention is in the form of a vertical cutter or of a slanted cutter used in the food industry and/or in retail shops, for purposes of slicing food products such as meat, cold cuts, fish or cheese.

Additional embodiments of the invention are shown in the figures and described in the appertaining description.

FIG. 1 shows a slicing machine 1 for cutting food products. The slicing machine 1 has a housing 13 in which a circular blade 11 and a carriage 2 that can be moved back and forth are mounted on a carriage foot 21. The carriage 2 can be moved manually. The housing 13 also has a stop plate 12 that serves to set the thickness of the food slices that are to be cut.

Inside the housing 13, there is a motor tower 14 in which a motor is arranged that causes the blade 11 to rotate. The slicing machine or the motor can be actuated by means of an operating panel 15 arranged on the motor tower 14. The stop plate 12 runs parallel to the blade 11 or to the cutting plane defined by the blade, and forms a stop for the food that has been placed onto the carriage 2. An adjustment device 5 with an adjustment dial 51 arranged on the outside of the housing 13 can be used to adjust the distance between the stop plate and the circular blade 11, and thus the desired slice thickness of the food that is to be sliced.

On the circumference of the blade 11, there is a cutting edge that is covered by a blade protection ring 16 that is firmly joined to the housing 13. The blade protection ring 22 surrounds the cutting edge in a C-shaped manner and leaves only a small front area of the cutting edge free for cutting purposes. The front free area faces the stop plate 13 and more or less of it is exposed, depending on the selected slice thickness. The stop plate 13 covers this area of the cutting edge completely whenever the cutting thickness is set below zero. In this setting, the cutting edge of the blade 11 is almost completely covered, so that risk of injury is largely ruled out. In order to facilitate cleaning, the carriage 2 can be tilted open around a pivot pin 25 after it has been unlocked using the knob 24. A blocking mechanism effectively prevents the carriage from being tilted open whenever the cutting edge of the blade is exposed.

Figure 2:
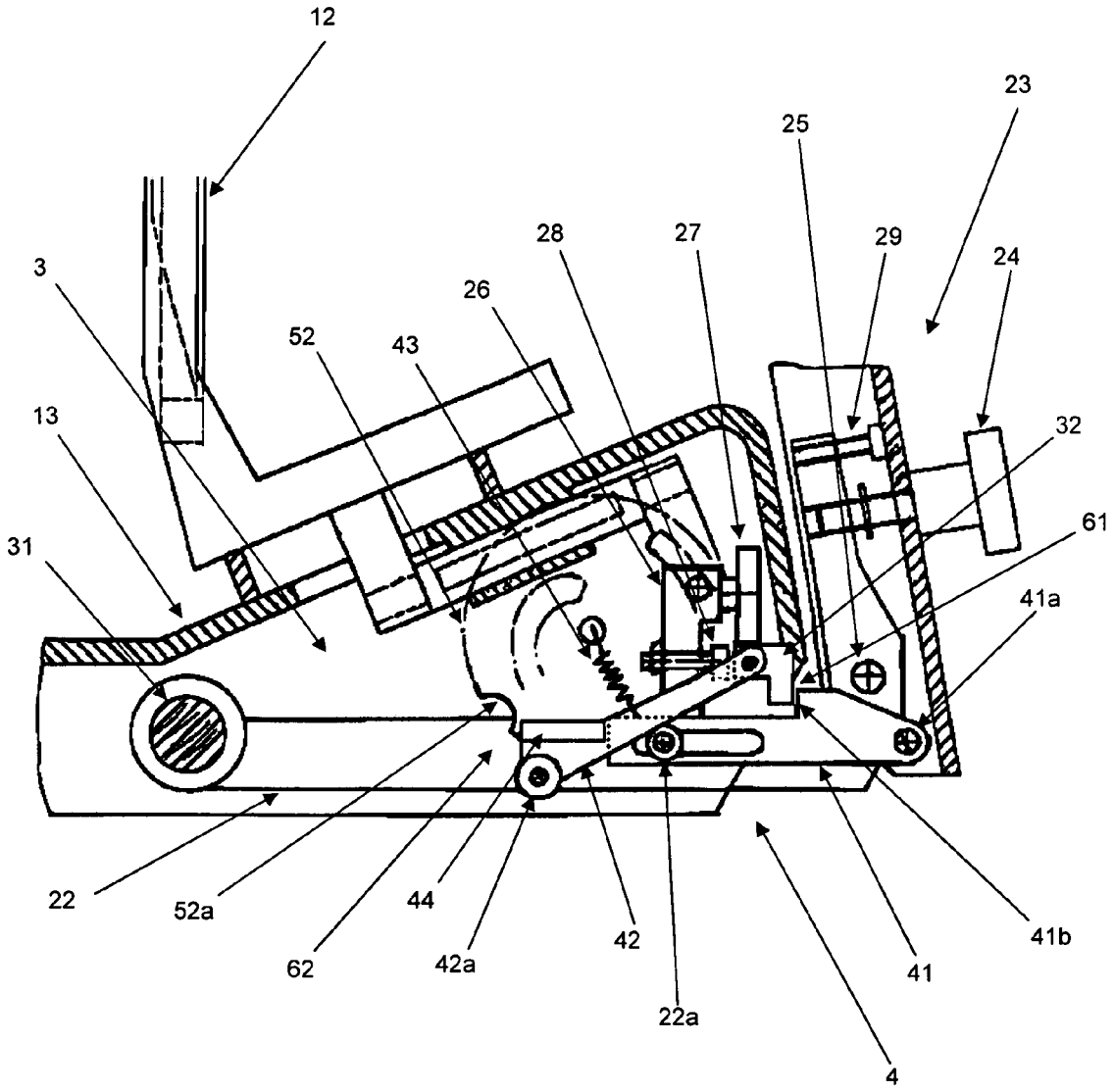
FIG. 2 a vertical sectional view of the slicing machine, perpendicular to the cutting plane when the carriage is blocked.

FIG. 2 shows an enlarged sectional view of the area of the carriage guide 2 and of the blocking mechanism 4 when the carriage 2 is blocked.

Figure 3:
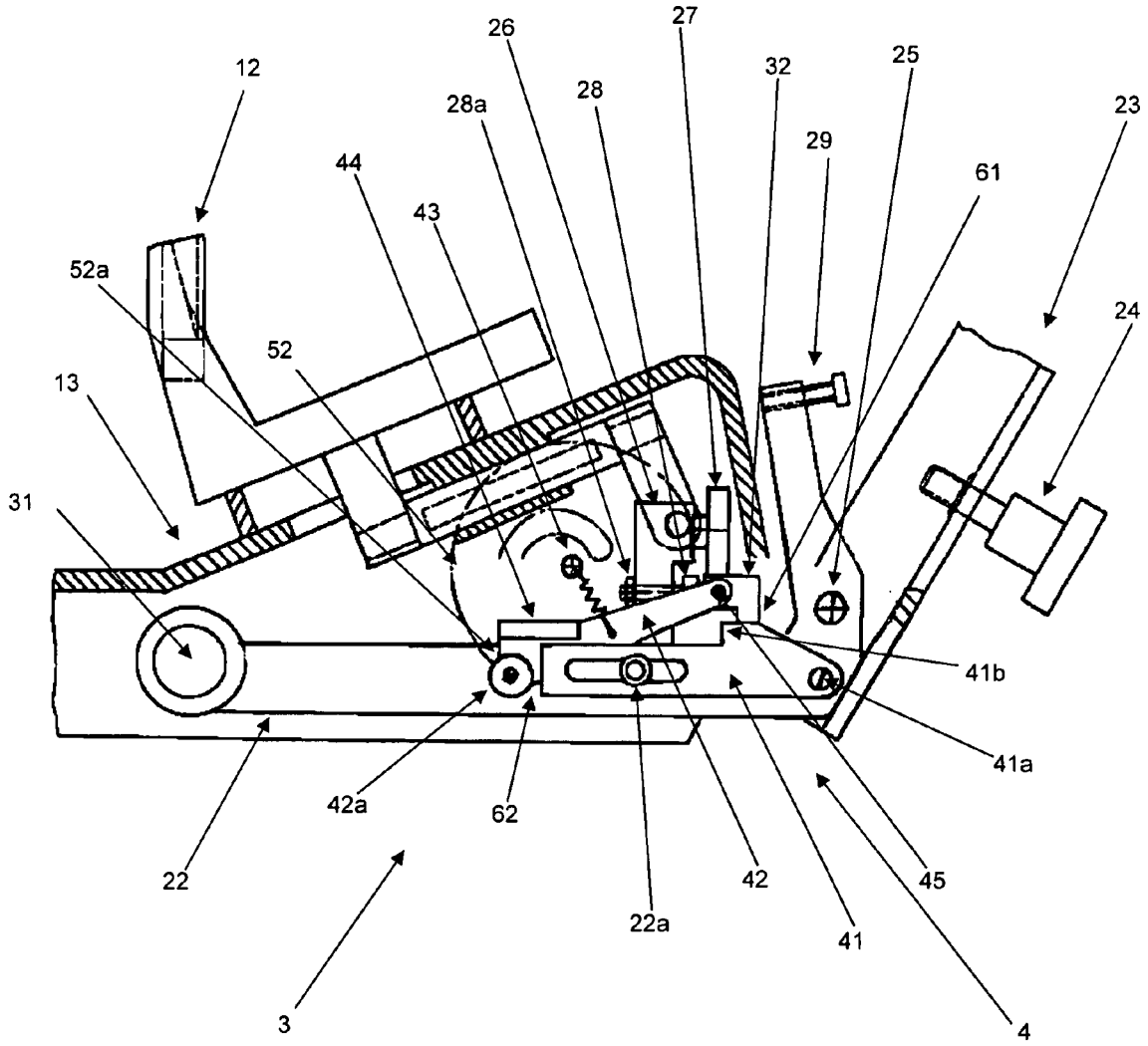
FIG. 3 a vertical sectional view of the slicing machine, perpendicular to the cutting plane when the carriage is unblocked.
Figure 4:
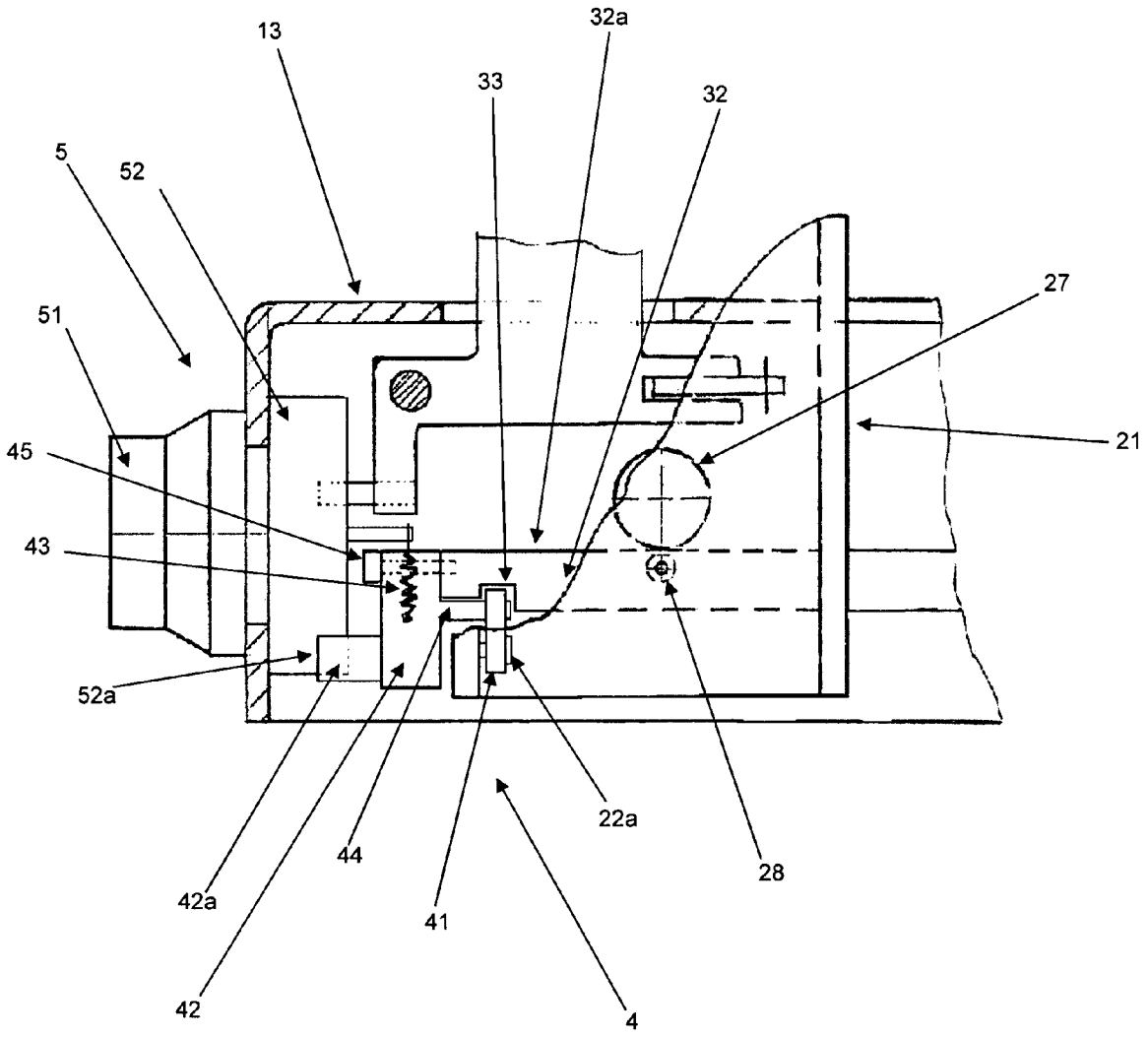
FIG. 4 a vertical sectional view of the slicing machine, parallel to the cutting plane when the carriage is unblocked.

FIG. 3 shows the same sectional view as FIG. 2, but with the carriage tilted open. For purposes of illustrating the perspective, FIG. 4 shows the same sectional view in a side view rotated by 90°.

The carriage 2 is joined to the housing 13 by means of a two-part carriage foot 21. The carriage foot 21 has a tilting upper part 23 that is pivotably joined to the lower part 22 by means of the pin 25. An adjustable bolt 29 serves to precisely set the horizontal orientation of the contact surface of the carriage 2.

The lower part of the carriage foot 22 is joined to the housing 13 by means of a guide device 3 that has two bearing points, namely, a guide pin 31 and a guide rail 32. The guide pin 31 and the guide rail 32 are firmly joined to the housing 13 and they run parallel to each other. The guide pin 31 extends over the entire length of the slicing machine housing 13 and is firmly anchored in its faces. The guide rail 32 likewise runs over a large portion of the length of the machine housing and it has a sliding surface for a roller 27 at the top.

A sleeve arranged at the end of the lower part of the carriage foot 22 surrounds the guide pin 31, said lower part having a leg 26 protruding at a right angle upwards which supports the roller 27 that rests on the guide rail 32. Thus, the carriage is firmly joined to the machine housing by means of two bearings and can be moved along the length of the machine housing parallel to the cutting plane. An adjustable sliding pin 28 secured on the leg 26 can be used to compensate for any play that might exist in the guide device 3.

In order to swing out the carriage, a knob 24 on a thread is turned to release the connection between the upper part 23 and the lower part 22 of the carriage foot, so that the upper part 23 that is firmly joined to the carriage 2 can be swung or tilted around the pivot joint 25.

A blocking mechanism 4 ensures that the carriage 2 can only be tilted out if the carriage is in a defined end position and, at the same time, the cutting thickness is set below zero, in other words, the stop plate 12 is covering the cutting edge of the blade 11. The blocking mechanism 4 prevents the carriage from swinging out inadvertently by appropriately preventing or permitting a linear movement of the blocking slide 41. Here, the blocking slide 41 has a first blocking mechanism 61 and a second blocking mechanism 62 in order to block the carriage 2 from swinging out.

The first blocking mechanism 61 of the blocking slide 41 has a blocking tab 41*b* extending upwards or downwards which is shaped onto the blocking slide and which interacts directly with the guide rail 32. The second blocking mechanism 62 comprises the blocking bar 42 that interacts with the end of the blocking slide 41 facing away from the pivot bearing 41*a*.

In this process, two blocking members, namely, a blocking tab 41*b* and a blocking cam 44 interact in a mechanical AND operation. Both blocking members 41*b* and 44 have to release the blocking slide 41 simultaneously before the carriage 2 can be swung out.

The blocking slide 41 can be moved on the lower part of the carriage foot 22 by means of a mushroom-type pin 22*a* and is rotatably mounted on the upper part of the carriage foot by means of a pivot joint 41*a* that is arranged at a distance below the pivot point 25. When the carriage is swung out, the blocking slide 41 is thus moved linearly. The blocking slide 41 has a blocking tab 41*b* that interacts with the guide rail 32. At the defined end position of the carriage, the guide rail 32 has a groove 33 into which the blocking tab 41*b* can engage when the carriage is at the desired end position. If the carriage is to be swung out to another position, the blocking tab 41*b* comes into contact with the guide rail 32, thus preventing the blocking slide 41 from moving and the carriage from swinging out.

The second blocking member comprises a blocking bar 42 having a blocking cam 44 whose one end is rotatably supported on the guide rail 32. The blocking cam 44 interacts with the blocking slide 41 and prevents its movement, provided that the cutting thickness is not set below zero. At its other end, the blocking slide 41 has a blocking bolt 42*a* that rests on the circumferential surface of a control disk 52. A tension spring 43 that runs from the mid-point of the control disk 52 to the blocking bar 42 acts upon the blocking tab 42 in the direction of the circumferential surface of the control disk 52.

The control disk 52 is joined to the knob 51 and serves to set the slice thickness; it has a control cam for adjusting the stop plate 12. In the circumferential surface of the control disk 52, there is a recess 52*a* arranged at an appropriate position, so that the blocking bolt 42*a* can engage into this recess 52*a* when the slice thickness has been set to a cutting thickness below zero. As a result, the blocking bar 42 pivots in the direction of the control disk and carries along the blocking cam 44 that then is disengaged from the blocking slide 41, thus permitting the blocking slide 41 to move. Therefore, the blocking slide 41 interacts with two different blocking members 41*b* and 44 in that it is configured so as to be L-shaped, whereby the narrow part interacts with the blocking cam 44, while the part that is widened upwards forms the blocking tab 41*b* that interacts with the running rail 32.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise.

The invention claimed is:

1. A slicing machine for cutting slices of a food product, the machine comprising:

a machine housing including a circular blade that rotates in a cutting plane and a stop plate that is moveable by an adjustment device perpendicular to the cutting plane;

a guide device including a guide pin that runs parallel to the cutting plane and a guide rail arranged at a distance from the guide pin, the guide rail interacting with the adjustment device;

a carriage that is mounted so that it is moveable linearly on the guide pin and the guide rail parallel to the cutting plane, the carriage being configured to be swung out around a pivot pin that runs parallel to the guide pin; and a blocking mechanism including a blocking slide that is mounted to the carriage via a pivot bearing and a blocking bar, the blocking slide being configured to prevent the carriage from being swung out during a cutting operation by the guide rail and the blocking bar blocking movement of the blocking slide.

2. The slicing machine of claim 1, wherein the blocking mechanism is configured to permit the carriage to swing out in at least one defined position of the carriage by the blocking slide engaging into a groove of the guide rail.

3. The slicing machine of claim 1, wherein the blocking slide includes a blocking tab extending upwards, and wherein an end of the blocking slide facing away from the pivot bearing interacts directly with the blocking bar, while the blocking tab interacts directly with the guide rail.

4. The slicing machine of claim 1, wherein the carriage is joined to the machine housing by a two-part carriage foot, wherein a lower part of the carriage foot engages into the machine housing, is rotatably mounted on the guide rail and is rotatably joined to an upper part of the carriage foot.

5. The slicing machine of claim 4, wherein a lower part of the carriage foot is configured to secure the blocking slide so that the blocking slide is moveable linearly.

6. The slicing machine of claim 4, wherein a lower part of the carriage foot includes a leg that protrudes upwards and that rests on the guide rail in a vertical direction via a roller.

7. The slicing machine of claim 6, wherein the leg includes a sliding pin that interacts with the guide rail in a horizontal direction.

8. The slicing machine of claim 7, wherein a distance between the sliding pin and the guide rail is adjustable by a thread.

9. The slicing machine of claim 1, wherein the adjustment device includes a knob arranged on the outside of the housing which, in order to adjust the stop plate, turns a control disk that is arranged inside the machine housing and that includes a locking groove cut into its circumferential surface.

10. The slicing machine of claim 9, wherein a first end of the blocking bar is rotatably mounted on the guide rail and, in an area of a second end of the blocking bar, the blocking bar is supported under spring tension on the circumferential surface of the control disk.

11. The slicing machine of claim 9, wherein the blocking bar is configured to interact with the circumferential surface of the control disk by the blocking bar including a blocking bolt that is configured to enter the locking groove in order to release the blocking slide.

12. The slicing machine of claim 1, wherein the guide rail is arranged inside the machine housing at a lateral distance from the guide pin, and wherein a running surface of a roller runs along the guide rail above the guide pin.

13. The slicing machine of claim 1, wherein the blocking slide includes a blocking tab extending downwards, and wherein an end of the blocking slide facing away from the pivot bearing interacts directly with the blocking bar, while the blocking tab interacts directly with the guide rail.

14. The slicing machine of claim 13, wherein a lower part of the carriage foot is configured to secure the blocking slide so that the blocking slide is moveable linearly.

15. The slicing machine of claim 13, wherein a lower part of the carriage foot includes a leg that protrudes downwards and that rests on the guide rail in a vertical direction via a roller.

16. The slicing machine of claim 4, wherein a lower part of the carriage foot includes a leg that protrudes downwards and that rests on the guide rail in a vertical direction via a roller.

17. The slicing machine of claim 16, wherein that the leg includes a sliding pin that interacts with the guide rail in a horizontal direction.

18. The slicing machine of claim 17, wherein a distance between the sliding pin and the guide rail is adjustable by a thread.

19. The slicing machine of claim 9, wherein the locking groove is round.

20. The slicing machine of claim 9, wherein the guide rail is arranged inside the machine housing at a lateral distance from the guide pin, and wherein a running surface of a roller runs along the guide rail below the guide pin.

* * * * *